US007013876B1

(12) United States Patent
Puckett et al.

(10) Patent No.: US 7,013,876 B1
(45) Date of Patent: Mar. 21, 2006

(54) FUEL INJECTOR CONTROL SYSTEM

(75) Inventors: Daniel R. Puckett, Peoria, IL (US); W. John Love, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 11/094,516

(22) Filed: Mar. 31, 2005

(51) Int. Cl.
*F02M 51/00* (2006.01)

(52) U.S. Cl. ..... 123/490; 361/154

(58) Field of Classification Search ..... 123/472, 123/478, 490; 361/154
See application file for complete search history.

(56) References Cited

U.S. PATENT DOCUMENTS

| | | | | |
|---|---|---|---|---|
| 4,922,878 | A | 5/1990 | Shinogle et al. | |
| 5,053,911 | A * | 10/1991 | Kopec et al. | 361/154 |
| 5,701,870 | A | 12/1997 | Gottshall et al. | |
| 5,959,825 | A | 9/1999 | Harcombe | |
| 6,085,730 | A | 7/2000 | Coatesworth et al. | |
| 6,175,484 | B1 * | 1/2001 | Caruthers et al. | 361/154 |
| 6,539,925 | B1 * | 4/2003 | Rueger et al. | 123/490 |
| 6,584,961 | B1 | 7/2003 | Marceca et al. | |
| 6,606,978 | B1 | 8/2003 | Sugimoto et al. | |
| 2003/0010325 | A1 | 1/2003 | Reischl et al. | |
| 2003/0188717 | A1 | 10/2003 | Aubourg | |
| 2004/0056117 | A1 | 3/2004 | Wang et al. | |

* cited by examiner

*Primary Examiner*—Erick Solis
(74) *Attorney, Agent, or Firm*—Finnegan, Henderson, Farabow, Garrett & Dunner LLP

(57) ABSTRACT

A control system for a fuel injector is disclosed. The control system has a valve element movable between a first position and a second position, an armature connected to the valve element, a solenoid configured to move the armature and connected valve element, and a controller in communication the solenoid. The controller is configured to energize the solenoid at a first current level to initiate movement of the valve element from the first position toward the second position, at a second current level less than the first current level during movement of the valve element from the first position toward the second position, at a third current level less than the second current level after the valve element has reached the second position, and at a fourth current level less than the third current level after the valve element has been in the second position for a predetermined period of time.

29 Claims, 5 Drawing Sheets

FUEL INJECTOR CONTROL SYSTEM

TECHNICAL FIELD

The present disclosure is directed to a control system and, more particularly, to a control system for a fuel injector.

BACKGROUND

Common rail fuel injectors provide a way to introduce fuel into the combustion chamber of an engine. Typical common rail fuel injectors include an actuating solenoid that opens a fuel injector nozzle when the solenoid is energized. Fuel is then injected into the combustion chamber as a function of the time period during which the solenoid remains energized. Accurate control of both the delivery timing and duration of fuel is important to engine performance and emissions.

To optimize engine performance and emissions, engine manufacturers may vary the times when the solenoid is energized and de-energized, as well as the magnitude of the current applied to the solenoid. One such example is described in U.S. Pat. No. 4,922,878 (the '878 patent) issued to Shinogle et al. on May 8, 1990. The '878 patent describes a solenoid control circuit that controls actuation of an injector control valve. The solenoid control circuit provides a three tier current waveform having a pull-in current level, a hold-in current level, and an intermediate current level. Energizing the solenoid at the pull-in level starts movement of the control valve and the flow of fuel to the engine. After the control valve starts to move, the current level is reduced to the intermediate level, which is less than the pull-in current level but great enough to continue movement of the control valve. The applied current is then further reduced to the hold-in level to hold the control valve at the moved position. The solenoid may then be de-energized to return the control valve to its initial position to stop the flow of fuel to the engine.

Although the solenoid control circuit of the '878 patent may sufficiently inject fuel into an engine, it may do little to minimize bouncing of the control valve and the resulting effects. In particular, due to inertia of the moving control valve and the associated fuel, upon fully opening, the control valve may tend to bounce away from an upper seat, thereby adversely affecting fuel delivery characteristics. Because the hold-in current of the '878 patent is single tiered, it may be insufficient to fully minimize control valve bouncing. Alternatively, if the hold-in current of the '878 patent is sufficient to minimize control valve bouncing, it may be inefficient for holding the control valve at the moved position after the tendency to bounce has decreased. In addition, the '878 patent does not adjust the tier levels to accommodate the effects of bouncing between closely coupled injections or dampen the closing movements of the control valve to minimize the likelihood of return bouncing.

The control system of the present disclosure solves one or more of the problems set forth above.

SUMMARY OF THE INVENTION

One aspect of the present disclosure is directed to a control system for a fuel injector. The control system includes a valve element movable between a first position and a second position, and an armature connected to the valve element. The control system includes a solenoid configured to move the armature and connected valve, and a controller in communication with the solenoid. The controller is configured to energize the solenoid at a first current level to initiate movement of the valve element from the first position toward the second position, thereby initiating an injection of fuel. The controller is also configured to energize the solenoid at a second current level less than the first current level during movement of the valve element from the first position toward the second position and to energize the solenoid at a third current level less than the second current level after the valve element has reached the second position. The controller is further configured to energize the solenoid at a fourth current level less than the third current level after the valve element has been in the second position for a predetermined period of time and to de-energize the solenoid to return the valve element to the first position, thereby stopping the injection of fuel.

Another aspect of the present disclosure is directed to a method of controlling a fuel injector having a solenoid and an armature connected to a valve element movable between a first position and a second position. The method includes energizing the solenoid at a first current level to initiate movement of the valve element from the first position toward the second position, thereby initiating an injection of fuel. The method also includes energizing the solenoid at a second current level less than the first current level during movement of the valve element from the first position toward the second position and energizing the solenoid at a third current level less than the second current level after the valve element has reached the second position. The method further includes energizing the solenoid at a fourth current level less than the third current level after the valve element has been in the second position for a predetermined period of time and de-energizing the solenoid to return the valve element to the first position, thereby stopping the injection of fuel.

DETAILED DESCRIPTION

Figure 1:
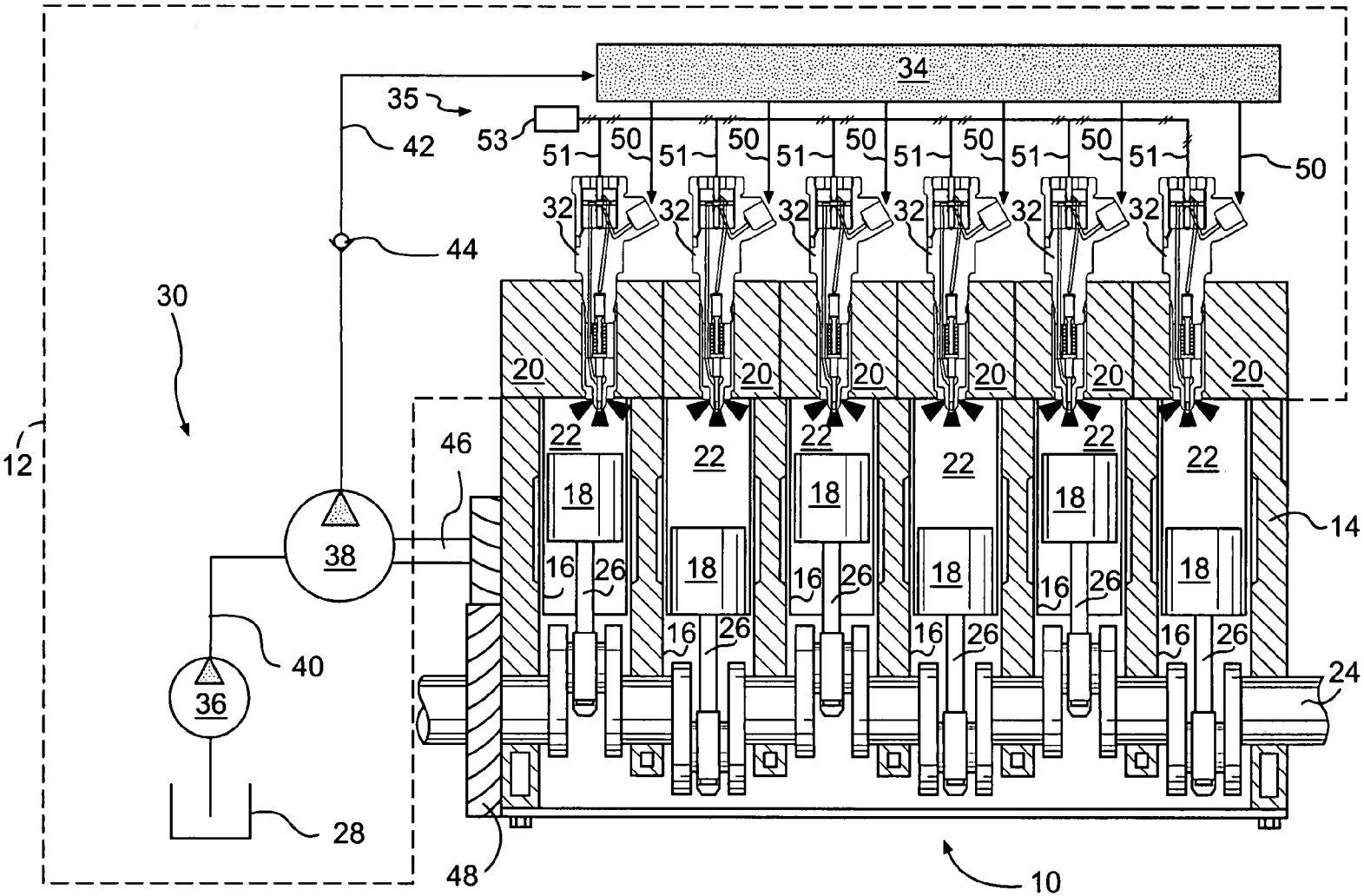
FIG. 1 is a schematic and diagrammatic illustration of an exemplary disclosed fuel system.

FIG. 1 illustrates an engine 10 and an exemplary embodiment of a fuel system 12. For the purposes of this disclosure, engine 10 is depicted and described as a four-stroke diesel engine. One skilled in the art will recognize, however, that engine 10 may be any other type of internal combustion engine such as, for example, a gasoline or a gaseous fuel-powered engine. Engine 10 may include an engine block 14 that defines a plurality of cylinders 16, a piston 18 slidably disposed within each cylinder 16, and a cylinder head 20 associated with each cylinder 16.

Cylinder 16, piston 18, and cylinder head 20 may form a combustion chamber 22. In the illustrated embodiment, engine 10 includes six combustion chambers 22. However, it is contemplated that engine 10 may include a greater or lesser number of combustion chambers 22 and that combustion chambers 22 may be disposed in an "in-line" configuration, a "V" configuration, or any other suitable configuration.

As also shown in FIG. 1, engine 10 may include a crankshaft 24 that is rotatably disposed within engine block 14. A connecting rod 26 may connect each piston 18 to crankshaft 24 so that a sliding motion of piston 18 within each respective cylinder 16 results in a rotation of crankshaft 24. Similarly, a rotation of crankshaft 24 may result in a sliding motion of piston 18.

Fuel system 12 may include components that cooperate to deliver injections of pressurized fuel into each combustion chamber 22. Specifically, fuel system 12 may include a tank 28 configured to hold a supply of fuel, a fuel pumping arrangement 30 configured to pressurize the fuel and direct the pressurized fuel to a plurality of fuel injectors 32 by way of a common rail 34, and a control system 35.

Fuel pumping arrangement 30 may include one or more pumping devices that function to increase the pressure of the fuel and direct one or more pressurized streams of fuel to common rail 34. In one example, fuel pumping arrangement 30 includes a low pressure source 36 and a high pressure source 38 disposed in series and fluidly connected by way of a fuel line 40. Low pressure source 36 may be a transfer pump configured to provide low pressure feed to high pressure source 38. High pressure source 38 may be configured to receive the low pressure feed and to increase the pressure of the fuel to the range of about 30–300 MPa. High pressure source 38 may be connected to common rail 34 by way of a fuel line 42. A check valve 44 may be disposed within fuel line 42 to provide for one-directional flow of fuel from fuel pumping arrangement 30 to common rail 34.

One or both of low pressure and high pressure sources 36, 38 may be operably connected to engine 10 and driven by crankshaft 24. Low and/or high pressure sources 36, 38 may be connected with crankshaft 24 in any manner readily apparent to one skilled in the art where a rotation of crankshaft 24 will result in a corresponding rotation of a pump drive shaft. For example, a pump driveshaft 46 of high pressure source 38 is shown in FIG. 1 as being connected to crankshaft 24 through a gear train 48. It is contemplated, however, that one or both of low and high pressure sources 36, 38 may alternatively be driven electrically, hydraulically, pneumatically, or in any other appropriate manner.

Fuel injectors 32 may be disposed within cylinder heads 20 and connected to common rail 34 by way of a plurality of fuel lines 50. Each fuel injector 32 may be operable to inject an amount of pressurized fuel into an associated combustion chamber 22 at predetermined timings, fuel pressures, and fuel flow rates. The timing of fuel injection into combustion chamber 22 may be synchronized with the motion of piston 18. For example, fuel may be injected as piston 18 nears a top-dead-center position in a compression stroke to allow for compression-ignited-combustion of the injected fuel. Alternatively, fuel may be injected as piston 18 begins the compression stroke heading towards a top-dead-center position for homogenous charge compression ignition operation. Fuel may also be injected as piston 18 is moving from a top-dead-center position towards a bottom-dead-center position during an expansion stroke for a late post injection to create a reducing atmosphere for aftertreatment regeneration.

Control system 35 may control operation of each fuel injector 32. In particular, control system 35 may include a controller 53 that communicates with fuel injectors 32 by way of a plurality of communication lines 51. Controller 53 may be configured to control a fuel injection timing, amount, and duration by applying a predetermined current waveform or sequence of current waveforms to each fuel injector 32.

Controller 53 may embody in a single microprocessor or multiple microprocessors that include a means for controlling an operation of fuel injector 32. Numerous commercially available microprocessors can be configured to perform the functions of controller 53. It should be appreciated that controller 53 could readily embody a general work machine or engine microprocessor capable of controlling numerous work machine or engine functions. Controller 53 may include all the components required to run an application such as, for example, a memory, a secondary storage device, and a processor, such as a central processing unit or any other means known in the art for controlling fuel injectors 32. Various other known circuits may be associated with controller 53, including power supply circuitry, signal-conditioning circuitry, solenoid driver circuitry, communication circuitry, and other appropriate circuitry.

Figure 2:
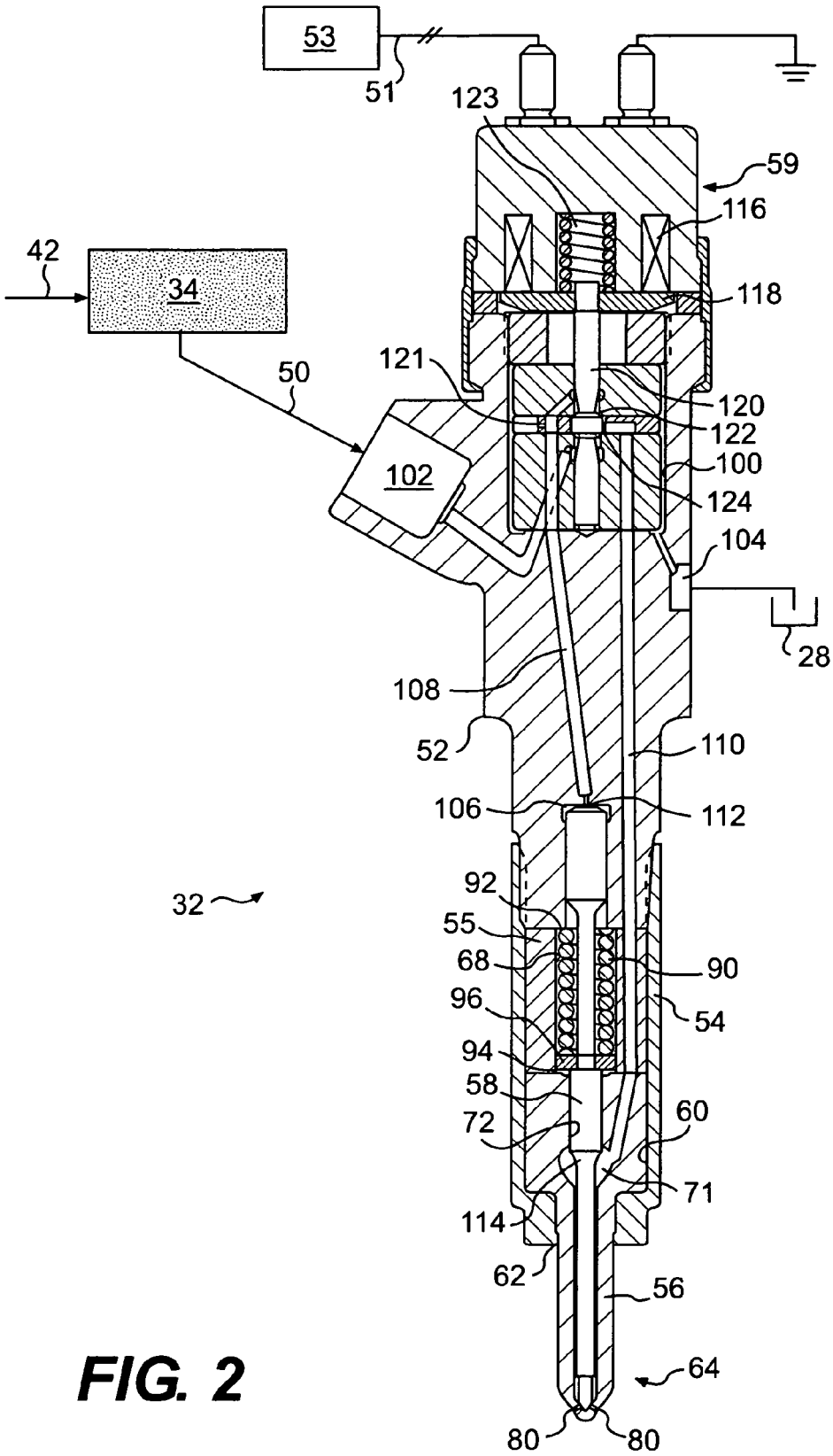
FIG. 2 is a cross-sectional illustration of an exemplary disclosed fuel injector for the fuel system of FIG. 1.

As illustrated in FIG. 2, each fuel injector 32 may be a closed nozzle unit fuel injector. Specifically, each fuel injector 32 may include an injector body 52, a housing 54 operably connected to injector body 52, a guide 55 disposed within housing 54, a nozzle member 56, a needle valve element 58, and a solenoid actuator 59. It is contemplated that additional components may be included within fuel injector 32 such as, for example, restricted orifices, pressure-balancing passageways, accumulators, and other injector components known in the art.

Injector body 52 may embody a cylindrical member configured for assembly within cylinder head 20 and having one or more passageways. Specifically, injector body 52 may include a central bore 100 configured to receive solenoid actuator 59, a fuel inlet 102 and fuel outlet 104 in communication with central bore 100, and a control chamber 106. Control chamber 106 may be in communication with central bore 100 via a control passageway 108 and in direct communication with needle valve element 58. Control chamber 106 may be selectively drained of or supplied with pressurized fuel to affect motion of needle valve element 58. Injector body 52 may also include a supply passageway 110 that fluidly communicates central bore 100 with nozzle member 56.

Housing 54 may embody a cylindrical member having a central bore 60 for receiving guide 55 and nozzle member 56, and an opening 62 through which a tip end 64 of nozzle member 56 protrudes. A sealing member such as, for example, an o-ring (not shown) may be disposed between guide 55 and nozzle member 56 to restrict fuel leakage from fuel injector 32.

Guide 55 may also embody a cylindrical member having a central bore 68 configured to receive needle valve element 58 and a return spring 90. Return spring 90 may be disposed between a stop 92 and a seating surface 94 to axially bias needle valve element 58 toward tip end 64. A spacer 96 may be disposed between return spring 90 and seating surface 94 to reduce wear of the components within fuel injector 32. It is contemplated that an additional spacer (not shown) may be disposed between return spring 90 and stop 92 to further reduce component wear.

Nozzle member 56 may likewise embody a cylindrical member having a central bore 72 and a pressure chamber 71. Central bore 72 may be configured to receive needle valve element 58. Pressure chamber 71 may hold pressurized fuel supplied from supply passageway 110 in anticipation of an injection event. Nozzle member 56 may also include one or more orifices 80 to allow the pressurized fuel to flow from pressure chamber 71 through central bore 72 into combustion chambers 22 of engine 10, as needle valve element 58 is moved away from orifices 80.

Needle valve element 58 may be an elongated cylindrical member that is slidingly disposed within guide 55 and nozzle member 56. Needle valve element 58 may be axially movable between a first position at which a tip end of needle valve element 58 blocks a flow of fuel through orifices 80, and a second position at which orifices 80 are open to allow a flow of fuel into combustion chamber 22. It is contemplated that needle valve member 58 may be a multi-member element having a needle member and a piston member or a single integral element.

Needle valve element 58 may have multiple driving hydraulic surfaces. For example, needle valve element 58 may include a hydraulic surface 112 tending to drive needle valve element 58, with the bias of return spring 90, toward a first or orifice-blocking position when acted upon by pressurized fuel. Needle valve element 58 may also include a hydraulic surface 114 that opposes the bias of return spring 90 to drive needle valve element 58 in the opposite direction toward a second or orifice-opening position when acted upon by pressurized fuel.

Solenoid actuator 59 may be disposed opposite nozzle member 56 to control the forces on needle valve element 58. In particular solenoid actuator 59 may include windings 116 of a suitable shape through which current may flow to establish a magnetic field. Solenoid actuator 59 may also include an armature 118 fixedly connected to a two-position control valve element 120. When energized, the magnetic field established by windings 116 may urge armature 118 and connected control valve element 120 against the bias of a return spring 123 from a first or non-injecting position to a second or injecting position. For example, control valve element 120 may be moved between a lower seat 122 and an upper seat 124. In the non-injecting position, fuel may flow from fuel inlet 102 through control passageway 108 into control chamber 106. As pressurized fuel builds within control chamber 106, the downward force generated at hydraulic surface 112 combined with the force of return spring 90 may overcome the upward force at hydraulic surface 114, thereby closing orifices 80 and terminating fuel injection. In the injecting position, fuel may flow from control chamber 106 to tank 28 via a restricted orifice 121, central bore 100, and fuel outlet 104. As fuel from control chamber 106 drains to tank 28, the upward force at hydraulic surface 114 may urge needle valve element 58 against return spring 90, thereby opening orifices 80 and initiating fuel injection into combustion chambers 22. When de-energized, return spring 123 may return armature 118 and control valve element 120 to the non-injecting position.

Figure 3A:
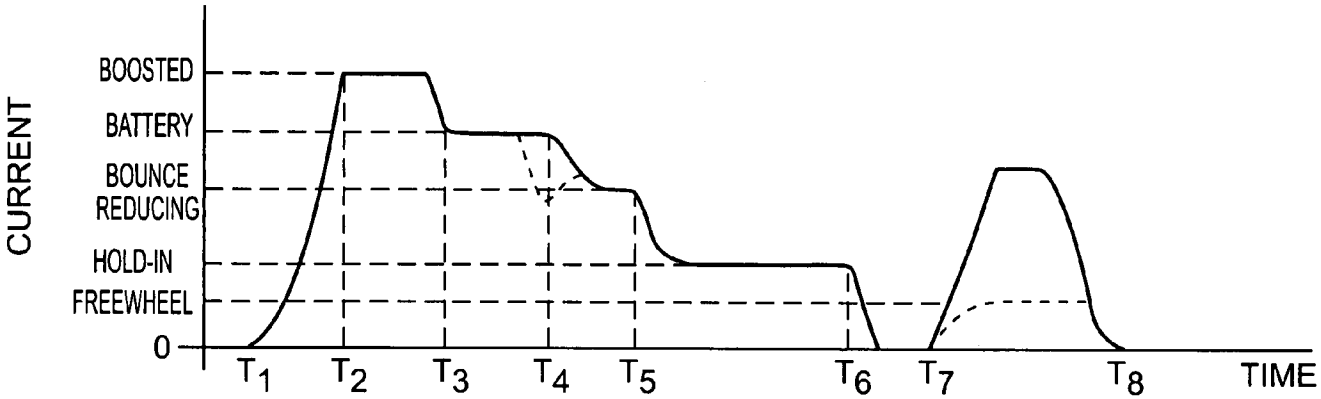
FIG. 3A is a control diagram for the fuel injector of FIG. 2.
Figure 3B:
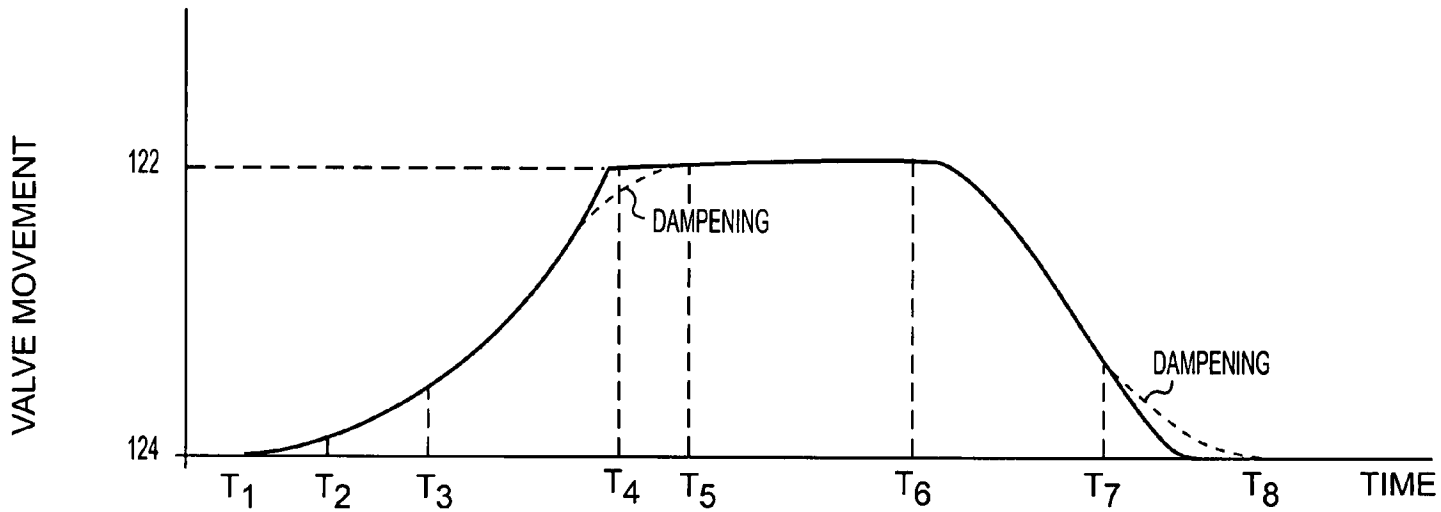
FIG. 3B is another control diagram for the fuel injector of FIG. 2.

The timing and level of the induced current within windings 116 may be controlled to affect fuel injection. For example, as illustrated in the control diagrams of FIGS. 3A and 3B, a first current level may be induced within windings 116 at time T1 to initiate movement of control valve element 120 toward the injecting position. The current level at time T1 may be induced by applying a boosted voltage to windings 116 that is at a level above a battery output voltage associated with engine 10. The voltage used to induce the first current level may be boosted through the use of a capacitor circuit (not shown) that raises the current to a sufficiently high level, thereby overcoming the effects of inertia. At time T2, a second current level may be induced within windings 116 that continues to move control valve element 120 toward the injecting position. Because control valve element 120 is already in motion at time T2, the second current level may be lower than the first and induced by applying a voltage at or near the battery output level associated with engine 10. At time T3, a third current level may be induced within windings 116 to counteract the tendency of control valve element 120 to bounce upon reaching upper seat 122 during movement toward the injecting position, and to overcome hydraulic inertia of the fuel in contact with control valve element 120. The third current level may be less than the second current level. At time T5, after the tendency of control valve element 20 to bounce has decreased, the current may be further reduced to a fourth or hold-in level that continues for the duration of fuel injection until time T6. The fourth current level may be high enough to overcome the force of return spring 123 and hold control valve element 120 in the injecting position. Each of the current levels from the first through the fourth may be less than the previous current level to conserve energy and to reduce the cooling requirements of solenoid actuator 59 while meeting the force requirements of control valve element 120. At time T6, the hold-in current level may be reduced to about zero to allow return spring 123 to move armature 118 and control valve element 120 to the non-injecting position. For the purposes of this disclosure, the combination of current levels induced within windings 116 to produce a single injection event may be considered a current waveform.

A current waveform associated with an exemplary injection event may also include dampening current levels. In particular, controller 53 may induce a fifth current level within windings 116 at time T7 to dampen or slow the movement of control valve element 120 prior to control valve element 120 reaching the injecting position (e.g., prior to time T8). The induced current may be of an appropriate level between zero and the current level at time T2. Dampening the closing movement of control valve element 120 just prior to time T8 may reduce the likelihood of control valve element 120 bouncing off of a lower seat 124. It is contemplated that instead of controller 53 inducing a fifth current, control valve element 120 may alternatively enter a freewheeling mode of operation where the kinetic energy of control valve element 120 is converted to electrical energy directed away from solenoid actuator 59 (freewheeling induced current indicated with a dashed line in FIG. 3A, between time T7 and T8). The conversion of kinetic energy to electrical energy may function to dampen the movement of control valve element 120 in moving from the non-injecting position to the injecting position.

The current levels induced within windings 116 may be adjusted to dampen the movement of control valve element 120 toward the non-injecting position between time T3 and T4. In particular, the current level induced within windings 116 may be reduced just prior to control valve element 120 reaching upper seat 122 to decrease the likelihood of control valve element 120 bouncing away from upper seat 122 and to lessen the effects of the associated hydraulic inertia. The current level immediately following time T3 may be reduced to an amount sufficient to dampen the movement of control valve element 120 while allowing adequate time to induce the third current level at time T4 (referring to the dashed line in FIG. 3A, between time T3 and T4). Alternatively, if time allows, a current level (not indicated) may be induced at time T3 that reverses the direction of the previously generated magnetic field to oppose movement of control valve element 120 toward the non-injecting position, thereby increasing the amount of dampening.

In addition to dampening the movement of control valve element 120, operation of control valve element 120 in the freewheeling mode may provide an indication of the relative positions between control valve element 120 and lower seat 124. In particular, the time during which the current generated from the movement of control valve element 120 toward the non-injecting position may be measured during each movement cycle of control valve element 120. These time measurements may then be averaged to determine an approximate amount of time that it takes for control valve element 120 to move from the injecting position to the non-injecting position. It is noted that this average time may change depending on the previous injection duration, the time before the next injection, the injected amounts, and any other injection-related characteristics. An elapsed time may then be compared with the average amount of time to determine a distance remaining between control valve element 120 and lower seat 124 or a time remaining before control valve element 120 engages lower seat 124.

The relative position between control valve element 120 and lower seat 124 may be used to trigger the current induced within windings 116 that dampen the movement of control valve element 120 toward the injecting position. In particular, controller 53 may be configured to initiate and terminate the induced current intended to dampen the movement of control valve element 120 toward the injecting position before control valve element 120 reaches lower seat 124 in order to minimize the likelihood of a return bounce caused by the dampening current. For example, if the previously averaged time required for control valve element 120 to move from the injecting position to the non-injecting position is 350 $\mu$s and the desired dampening duration is 100 $\mu$s, controller 53 may induce the dampening current at 250 $\mu$s or earlier after control valve element 120 has left the non-injecting position to prevent control valve element 120 from return bouncing away from lower seat 124 as a result of the dampening current.

Figure 4:
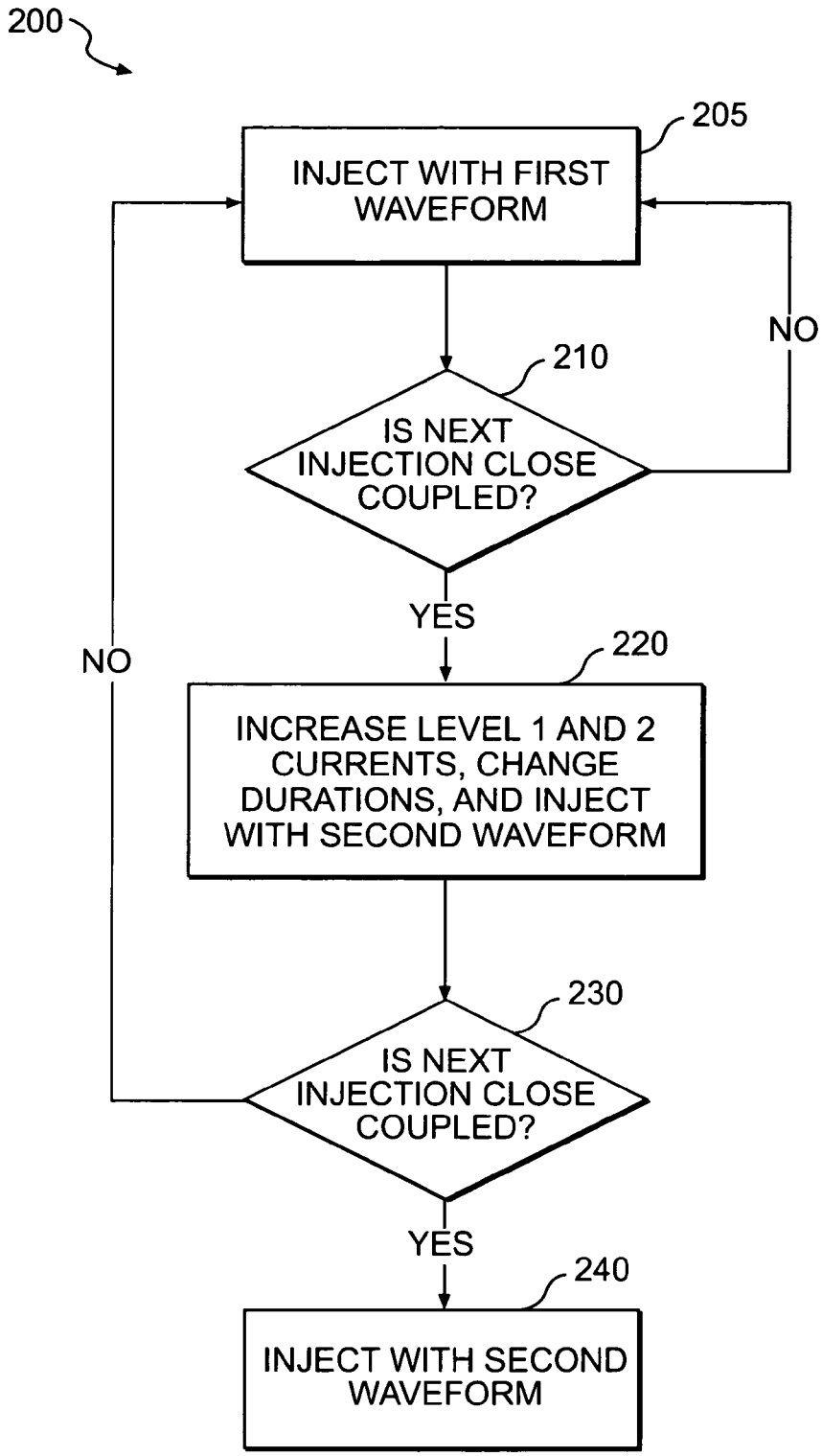
FIG. 4 is a flow chart depicting an exemplary method of operating the fuel injector of FIG. 2.
Figure 5:
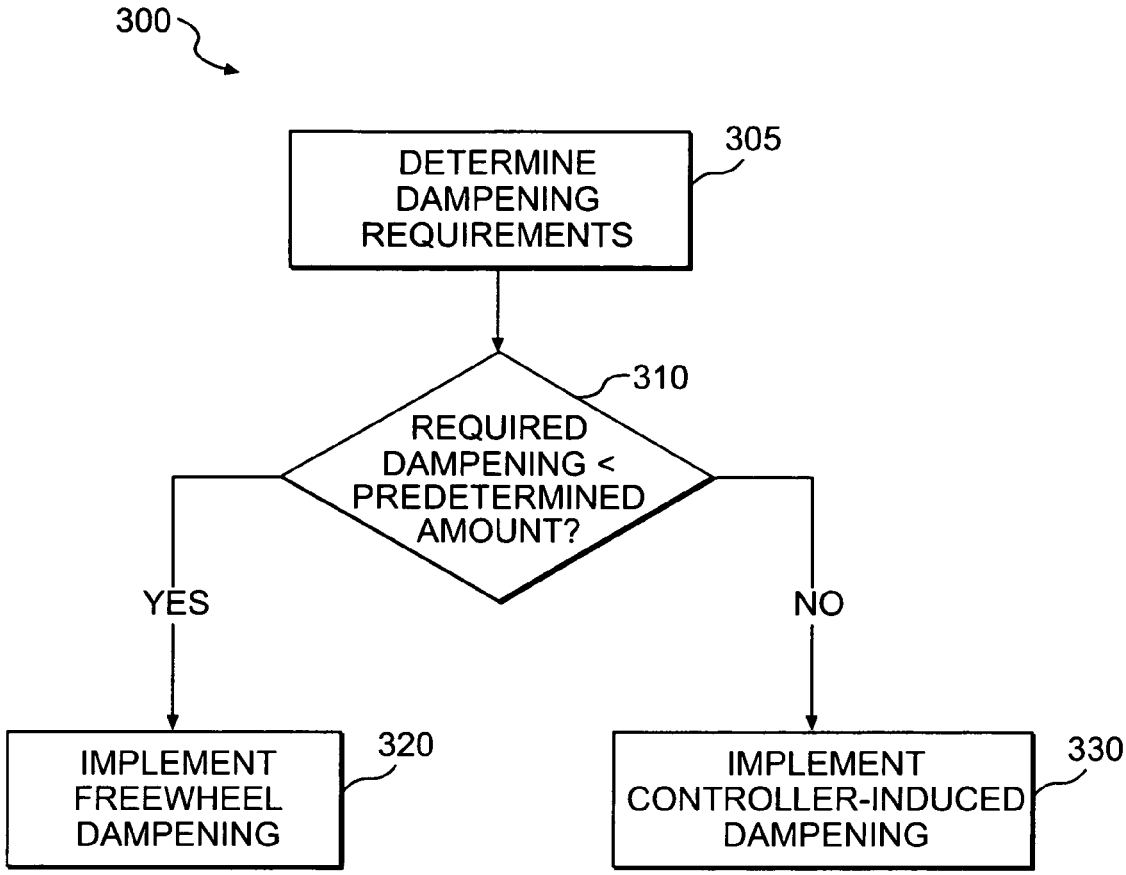
FIG. 5 is a flow chart depicting another exemplary method of operating the fuel injector of FIG. 2.

FIGS. 4 and 5 illustrate exemplary methods of operating control system 35. FIGS. 4 and 5 will be discussed in detail below.

INDUSTRIAL APPLICABILITY

The fuel injector control system of the present disclosure has wide applications in a variety of engine types including, for example, diesel engines, gasoline engines, and gaseous fuel-powered engines. The disclosed fuel injector control system may be implemented into any engine where consistent fuel injector performance and efficiency are important. The operation of control system 35 will now be explained.

As indicated in a flow chart 200 of FIG. 4, controller 53 may initiate a first injection of fuel into combustion chambers 22 of engine 10 (referring to FIG. 1) by applying a first waveform to solenoid actuator 59 (step 205). Injecting with the first waveform may include, for example, sequentially inducing current levels one through five as time progresses from T1 to T8 during an injection event (referring to FIGS. 3A and 3B). Specifically, the first or boosted voltage-induced current level may be induced within windings 116 to overcome the effects of inertia and initiate movement of control valve element 120 away from lower seat 124 during time T1 to T2. The second or battery-induced current level may be induced within windings 116 to continue movement of control valve element 120 toward the injecting position during time T2 to T4, after the inertial effects of accelerating control valve element 120 from a stopped position have diminished. The third or bounce-reducing current level may be induced during time T4 to T5 to hold control valve element 120 at the injecting position while overcoming tendencies for control valve element 120 to bounce away from upper seat 122. The fourth or hold-in current level may be induced within windings 116 during time T5 to T6 to hold control valve element in the injecting position at a reduced energy consumption level. Following time T6, the current level may be reduced to about zero to allow for the return of control valve element 120 to the non-injecting position. At time T7, the fifth current level may be induced within windings 116 to dampen the return of control valve element 120 to the non-injecting position.

Following the first injection, controller 53 may determine if a second injection event in a series of injection events is close-coupled (e.g., the time duration between the end of the first injection event and the start of the second injection event is less than a predetermined amount) (step 210). If the second injection event in a series of injection events is not close-coupled, the second injection event may be implemented in an identical manner to the first injection event by applying the first waveform to solenoid actuator 59.

However, if the second injection event is close-coupled, controller 53 may instead apply a second waveform to solenoid actuator 59. Specifically, in order to overcome the inertial effects of control valve element 120 returning to the non-injecting position and any associated bouncing, the first and/or second current levels of the second waveform may be increased from the current levels of the first waveform. In addition, because of the lack of time between the first injection event and the desired second close-coupled injection event, the application duration of the first one and/or two current levels of the second waveform may be reduced from the first waveform (step 220).

Following the second injection event in the series of injection events, controller 53 may again determine if a subsequent injection event is close-coupled (step 230). If the subsequent injection event is not close-coupled, controller 53 may return to injection using the first waveform. However, if the subsequent injection event is close-coupled, controller 53 may inject using the second waveform (step 240).

As illustrated in a flow chart 300 of FIG. 5, and as described above, controller 53 may either implement freewheel dampening or controller-induced dampening during the return movement of control valve element 120 to the non-injecting position. Specifically, controller 53 may determine an amount of required dampening by comparing the time between T6 and T7 (referring to FIGS. 3A and 3B), or between the end of the fourth applied current and the start of the dampening current (step 305) within a single waveform. Controller 53 may then determine if the required dampening is less than a predetermined dampening amount (step 310). If the time between T6 and T7 is so short that dampening occurs too early during the return of control valve element 120 to the non-injecting position, a controller-induced current may be generated within windings 116 to slow control valve element 120 before it returns to lower seat 124 (step 330). However, if the time between T6 and T7 is sufficiently long, freewheel dampening may be implemented (step 320)

Because control system 35 can implement waveforms having multiple hold-in current levels, the tendency of control valve element 120 to bounce and the energy consumed during an injection event may be reduced. Specifically, because control system 35 can implement the third current level after time T4 when control valve element 120 has reached the injecting position, the likelihood of control valve element 120 bouncing away from upper seat 122 may be reduced. In addition, because control system 35 may reduce the current level induced within windings 116 to the fourth current level after time T5, when the likelihood of bouncing has been reduced, the amount of energy consumed during the injection event may be less than if the current level had remained at the higher third current level.

Further, because control system 35 can modify the waveforms when sequential injection events are close-coupled, the performance of fuel injectors 32 may be increased. In particular, because close-coupled injection events have different current level and duration requirements than injection events that are not close-coupled, these differences must be accommodated to produce consistent injections of fuel. Controller 53 may accommodate these differences by increasing the current level and decreasing the current duration of the subsequent close-coupled injection event.

In addition, because control system 35 implements dampening of control valve element 120, the components of fuel injector 32 may experience less wear and the performance of fuel injectors 32 may be improved. Dampening of the movement of control valve element 120 prior to impact with upper or lower seats 122, 124 may reduce the force of the impact and the likelihood of bouncing away from the seat. The reduction in force may result in increased component life. Further, reducing the likelihood of bouncing can improve injector consistency.

It will be apparent to those skilled in the art that various modifications and variations can be made to the control system of the present disclosure without departing from the scope of the disclosure. Other embodiments will be apparent to those skilled in the art from consideration of the specification and practice of the control system disclosed herein. It is intended that the specification and examples be considered as exemplary only, with a true scope of the disclosure being indicated by the following claims and their equivalents.

What is claimed is:

1. A control system for a fuel injector, comprising:

a valve element movable between a first position and a second position;

an armature connected to the valve element;

a solenoid configured to move the armature and connected valve element; and a controller in communication the solenoid, the controller configured to:

energize the solenoid at a first current level to initiate movement of the valve element from the first position toward the second position, thereby initiating an injection of fuel;

energize the solenoid at a second current level less than the first current level during movement of the valve element from the first position toward the second position;

energize the solenoid at a third current level less than the second current level after the valve element has reached the second position;

energize the solenoid at a fourth current level less than the third current level after the valve element has been in the second position for a predetermined period of time; and de-energize the solenoid to return the valve element to the first position, thereby stopping the injection of fuel.

2. The control system of claim 1, wherein the controller is further configured to energize the solenoid at a fifth current level less than the third current level to slow the valve element during movement from the first position toward the second position.

3. The control system of claim 2, wherein the controller is configured to energize the solenoid at the fifth current level after energizing the valve element at the second current level and before energizing the valve element at the third current level, during a single injection event.

4. The control system of claim 1, wherein the controller is further configured to determine the time from the end of a first injection to the start of a subsequent injection and to increase the magnitude of at least one of the first and second current levels of the subsequent injection if the determined time is less than a predetermined time.

5. The control system of claim 4, wherein the controller is further configured to decrease the duration during which the solenoid is energized to at least one of the first and second current levels of the subsequent injection if the determined time is less than a predetermined time.

6. The control system of claim 1, wherein the second current level corresponds to a battery-induced current level.

7. The control system of claim 6, wherein the first current level is greater than the battery-induced current level.

8. The control system of claim 1, wherein the controller is further configured to energize the solenoid at a fifth current level during movement of the valve element from the second position toward the first position to slow the valve element.

9. The control system of claim 8, wherein the controller is further configured to determine a desired dampening associated with the valve element moving from the second position toward the first position and to compare the desired dampening to a predetermined dampening level, the fifth current level being a freewheeling-generated current level when the desired dampening is less than the predetermined dampening level and a current level greater than a battery-induced current level when the desired dampening is greater than a predetermined dampening level.

10. The control system of claim 1, further including a freewheeling circuit configured to generate a current from the interaction of the solenoid and the armature during movement of the valve element from the second position toward the first position.

11. The control system of claim 10, wherein the current generated by the freewheeling circuit is also used to indicate a relative position of the valve element to a seat.

12. A method of controlling a fuel injector having a solenoid and an armature connected to a valve element movable between a first and second position, the method comprising:

energizing the solenoid at a first current level to initiate movement of the valve element from the first position toward the second position, thereby initiating an injection of fuel;

energizing the solenoid at a second current level less than the first current level during movement of the valve element from the first position toward the second position;

energizing the solenoid at a third current level less than the second level after the valve element has reached the second position;

energizing the solenoid at a fourth current level less than the third current level after the valve element has been in the second position for a predetermined period of time, and de-energizing the solenoid to return the valve element to the first position, thereby stopping the injection of fuel.

13. The method of claim 12, further including energizing the solenoid at a fifth current level less than the third current level to slow the valve element during movement from the first position toward the second position.

14. The method of claim 13, wherein energizing the solenoid at the fifth current level includes energizing the solenoid at the fifth current level after energizing the valve element at the second current level and before energizing the valve element at the third current level, during a single injection event.

15. The method of claim 12, further including:

determining the time from the end of a first injection to the start of a subsequent injection; and increasing the magnitude of at least one of the first and second current levels of the subsequent injection if the determined time is less than a predetermined time.

16. The method of claim 15, further including decreasing the duration during which the solenoid is energized to at least one of the first and second current levels of the subsequent injection if the determined time is less than a predetermined time.

17. The method of claim 12, wherein the second current level corresponds to a battery-induced current level.

18. The method of claim 17, wherein the first current level is greater than the battery-induced current level.

19. The method of claim 12, further including energizing the solenoid at a fifth current level during movement of the valve element from the second position toward the first position to slow the valve element.

20. The method of claim 19, further including:

determining a desired dampening associated with the valve element moving from the second position toward the first position; and comparing the desired dampening to a predetermined dampening level, wherein the fifth current level is a freewheeling-generated current level when the desired dampening is less than the predetermined dampening level and a current level greater than a battery-induced current level when the desired dampening is greater than the predetermined dampening level.

21. The method of claim 12, further including generating a current from the interaction of the solenoid and the armature during movement of the valve element from the second position toward the first position.

22. The method of claim 21, further including determining a relative position of the valve element to a seat based on the generated current.

23. A fuel system for an engine having at least one combustion chamber, the fuel system comprising:

a source of pressurized fuel;

at least one fuel injector configured to inject the pressurized fuel into the at least one combustion chamber, the fuel injector including:

a solenoid;

an armature movable by the solenoid; and a valve element fixedly connected to the armature, wherein movement of the valve element from a first position toward a second position initiates injection of pressurized fuel into the at least one combustion chamber; and a control system, including a controller in communication with the solenoid, the controller being configured to:

energize the solenoid at a first current level to initiate movement of the valve element from the first position toward the second position, thereby initiating an injection of fuel, the first current level being greater than a battery-induced current level;

energize the solenoid at the battery-induced current level during movement of the valve element from the first position toward the second position;

energize the solenoid at a third current level less than the battery-induced current level after the valve element has reached the second position;

energize the solenoid at a fourth current level less than the third current level after the valve element has been in the second position for a predetermined period of time; and de-energize the solenoid to return the valve element to the first position, thereby stopping the injection of fuel.

24. The fuel system of claim 23, wherein the controller is further configured to energize the solenoid at a fifth current level after energizing the valve element at the battery-induced current level and before energizing the valve element at the third current level to slow the valve element during movement from the first position toward the second position, the fifth current level being less than the third current level.

25. The fuel system of claim 23, wherein the controller is further configured to determine the time from the end of a first injection to the start of a subsequent injection and to increase the magnitude of at least one of the first current level and the battery-induced current level of the subsequent injection if the determined time is less than a predetermined time.

26. The fuel system of claim 25, wherein the controller is further configured to decrease the duration during which the solenoid is energized to at least one of the first current level and the battery-induced current level of the subsequent injection if the determined time is less than the predetermined time.

27. The fuel system of claim 23, wherein the controller is further configured to energize the solenoid at a fifth current level during movement of the valve element from the second position toward the first position to slow the valve element.

28. The fuel system of claim 27, wherein the controller is further configured to determine a desired dampening associated with the valve element moving from the second position toward the first position and to compare the desired dampening to a predetermined dampening level, the fifth current level being a freewheeling-generated current level when the desired dampening is less than the predetermined dampening level and a first current level greater than a battery-induced current level when the desired dampening is greater than a predetermined dampening level.

29. The fuel system of claim 23, further including a freewheeling circuit configured to generate a current from the interaction of the solenoid and the armature during movement of the valve element from the second position toward the first position, the controller further configured to determine a relative position of the valve element to a seat based on the generated current.

* * * * *